US007936894B2

(12) United States Patent
Zurek

(10) Patent No.: US 7,936,894 B2
(45) Date of Patent: May 3, 2011

(54) MULTIELEMENT MICROPHONE

(75) Inventor: Robert A. Zurek, Antioch, IL (US)

(73) Assignee: Motorola Mobility, Inc., Libertyville, IL (US)

( * ) Notice: Subject to any disclaimer, the term of this patent is extended or adjusted under 35 U.S.C. 154(b) by 1431 days.

(21) Appl. No.: 11/021,395

(22) Filed: Dec. 23, 2004

(65) Prior Publication Data

US 2006/0140431 A1 Jun. 29, 2006

(51) Int. Cl.
*H04R 9/08* (2006.01)

(52) U.S. Cl. ..... 381/357

(58) Field of Classification Search ..... 381/357, 381/355, 365, 356, 92, 122, 358, 91, 313, 381/361; 379/431, 433.03
See application file for complete search history.

(56) References Cited

U.S. PATENT DOCUMENTS

| | | | | |
|---|---|---|---|---|
| RE19,115 | E * | 3/1934 | Olson et al. | 381/357 |
| 2,552,878 | A * | 5/1951 | Wiggins | 381/173 |
| 3,860,928 | A * | 1/1975 | Ehrlich | 342/375 |
| 5,479,522 | A * | 12/1995 | Lindemann et al. | 381/23.1 |
| 5,490,220 | A | 2/1996 | Loeppert | |
| 5,870,482 | A | 2/1999 | Loeppert et al. | |
| 6,069,963 | A * | 5/2000 | Martin et al. | 381/313 |
| 6,535,460 | B2 | 3/2003 | Loeppert et al. | |
| 6,614,911 | B1 | 9/2003 | Bryson et al. | |
| 6,667,189 | B1 | 12/2003 | Wang et al. | |
| 7,340,068 | B2 * | 3/2008 | Petersen et al. | 381/92 |
| 2002/0110256 | A1 | 8/2002 | Watson et al. | |
| 2003/0147538 | A1 * | 8/2003 | Elko | 381/92 |
| 2003/0160862 | A1 | 8/2003 | Charlier et al. | |
| 2003/0179894 | A1 * | 9/2003 | Saltykov | 381/313 |
| 2003/0209383 | A1 | 11/2003 | Whitman et al. | |
| 2004/0113153 | A1 | 6/2004 | Wong et al. | |

FOREIGN PATENT DOCUMENTS

WO 03075605 A1 9/2003

* cited by examiner

*Primary Examiner* — Vivian Chin
*Assistant Examiner* — Kile Blair
(74) *Attorney, Agent, or Firm* — Sylvia Chen; Daniel R. Collopy

(57) ABSTRACT

An improved microphone assembly (128) is provided for porting two microphones (240, 242) of an opposing pair used for beam forming through a single symmetric porting structure (244). The microphone assembly (128) includes a first microphone capsule (240), a second microphone capsule (242) and a porting structure (244). The porting structure (244) encloses the first and second microphone capsules (240, 242) therein and has a first port (251) formed in a first wall (246) thereof and a second port (252) formed in a second wall (248) thereof opposite to the first wall (246), where the first and second microphone capsules (240, 242) share the first port (251).

11 Claims, 6 Drawing Sheets

MULTIELEMENT MICROPHONE

CROSS-REFERENCES TO RELATED APPLICATIONS

This application is related to the following U.S. patent applications:

application Ser. No. 11/021,350 entitled "Method and Apparatus for Audio Signal Enhancement" by Robert A. Zurek; and the related application is filed on even date herewith, is assigned to the assignee of the present application, and is hereby incorporated herein in its entirety by this reference thereto.

FIELD OF THE INVENTION

The present invention generally relates to portable communications and recording devices, and more particularly relates to microphones for such devices.

BACKGROUND OF THE INVENTION

A present trend in portable communications devices is to reduce the size of these devices. Some components of the devices are more susceptible to size reduction then other components. While the size of microphones, for example, can be reduced through conventional micro-engineering techniques such as micro-electromechanical systems (MEMS), the small microphones degrade the devices' ability to receive the user's audio inputs. Also, the placement of the microphone in some portable communication devices such as automotive communication systems and emergency medical technician headgear increases the reception of ambient noise. Thus, in portable communications systems and automotive systems it is desirable to implement very small microphone arrays which provide audio signal enhancement. Planar arrays of like microphones reduced to the scale of a single element, however, cannot beam form at audio frequencies using known array techniques.

Thus, what is needed is a physical microphone system that can utilize array technology able to reduce microphones to near point sources. Furthermore, other desirable features and characteristics of the present invention will become apparent from the subsequent detailed description of the invention and the appended claims, taken in conjunction with the accompanying drawings and this background of the invention.

BRIEF DESCRIPTION OF THE DRAWINGS

The present invention will hereinafter be described in conjunction with the following drawing figures, wherein like numerals denote like elements.

DETAILED DESCRIPTION OF THE EMBODIMENTS

An improved microphone assembly is provided for porting two microphones through a single porting structure. The microphone assembly includes a first microphone capsule, a second microphone capsule and a porting structure. The porting structure encloses the first and second microphone capsules and has a first port formed in a first wall thereof and a second port formed in a second wall thereof, where the first wall is opposite to the second wall and where the first and second microphone capsules share the first port.

The following detailed description of the embodiments is merely exemplary in nature and is not intended to limit the invention or the application and uses of the invention. Furthermore, there is no intention to be bound by any theory presented in the preceding background of the invention or the following detailed description of the invention.

Figure 1:
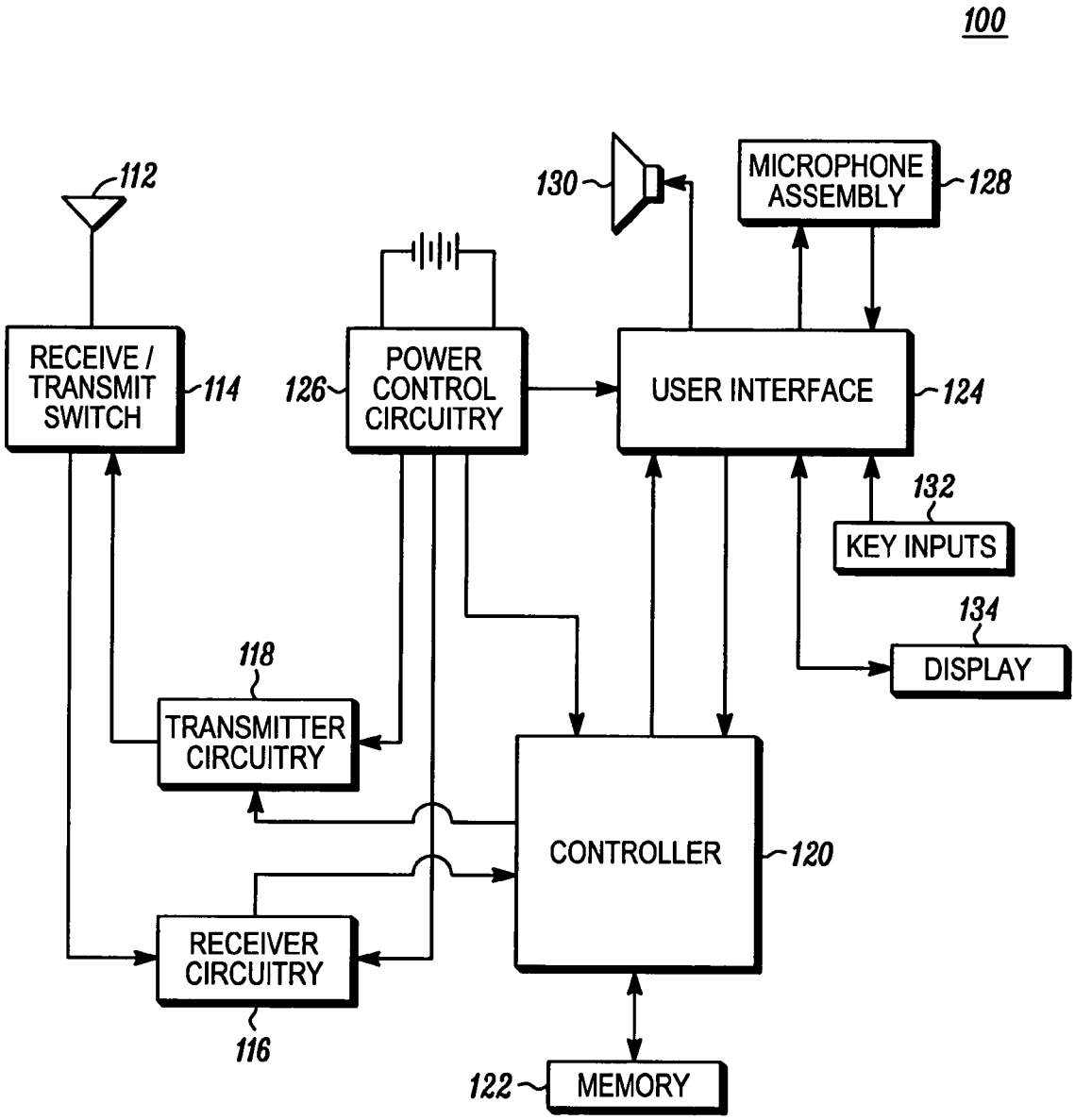
FIG. 1 is a block diagram of an electronic device in accordance with a first embodiment.

FIG. 1 depicts a block diagram of an electronic device 100, such as a cellular telephone, in accordance with a first embodiment. Although the electronic device 100 depicted is a cellular telephone, the electronic device 100 can be an audio recording device, a voice-controlled electronic device, or another environment for a microphone assembly 128. The electronic device 100 includes an antenna 112 for receiving and transmitting radio frequency (RF) signals. A receive/transmit switch 114 selectively couples the antenna 112 to receiver circuitry 116 and transmitter circuitry 118 in a manner familiar to those skilled in the art. The receiver circuitry 116 demodulates and decodes the RF signals to derive information, which is coupled to a controller 120 for providing the decoded information thereto for utilization thereby in accordance with the function(s) of the electronic device 100. The controller 120 also provides information to the transmitter circuitry 118 for encoding and modulating information into RF signals for transmission from the antenna 112. As is well-known in the art, the controller 120 is typically coupled to a memory device 122 and a user interface 124 to perform the functions of the electronic device 100. Power control circuitry 126 is coupled to the components of the electronic device 100, such as the controller 120, the receiver circuitry 116, the transmitter circuitry 118 and/or the user interface 124, to provide appropriate operational voltage and current to those components. The user interface 124 includes a microphone assembly 128, a speaker 130 and one or more key inputs 132, including a keypad. The user interface 124 may also include a display 134 which could accept touch screen inputs.

The microphone assembly 128 operates under the control of signals from the controller 120 to receive acoustic input and generate information to provide to the controller 120. The controller 120 processes the information from the microphone assembly 128 in accordance with a predetermined processing scheme. Conventional processing equations are distance and delay dependent, where the distance and delay refer to characteristics of the microphone assembly 128. As the distance of separation between the microphones in a microphone assembly 128 is reduced to near zero, the assembly ceases to function as more than a single microphone. Newer linear and nonlinear processing techniques, as referred to in the related U.S. patent application Ser. No. 11/021,350 entitled "Method and Apparatus for Audio Signal Enhancement" by Robert A. Zurek, form beam patterns from multiple physical microphone elements in the microphone assembly 128, and the physical dimensions of the microphone assembly 128 can be reduced in size to a diameter near to the size of the microphone elements. These newer linear and nonlinear processing techniques can also steer the beam patterns through a circle or sphere depending on the array configuration and number of microphone elements used.

Figure 2:
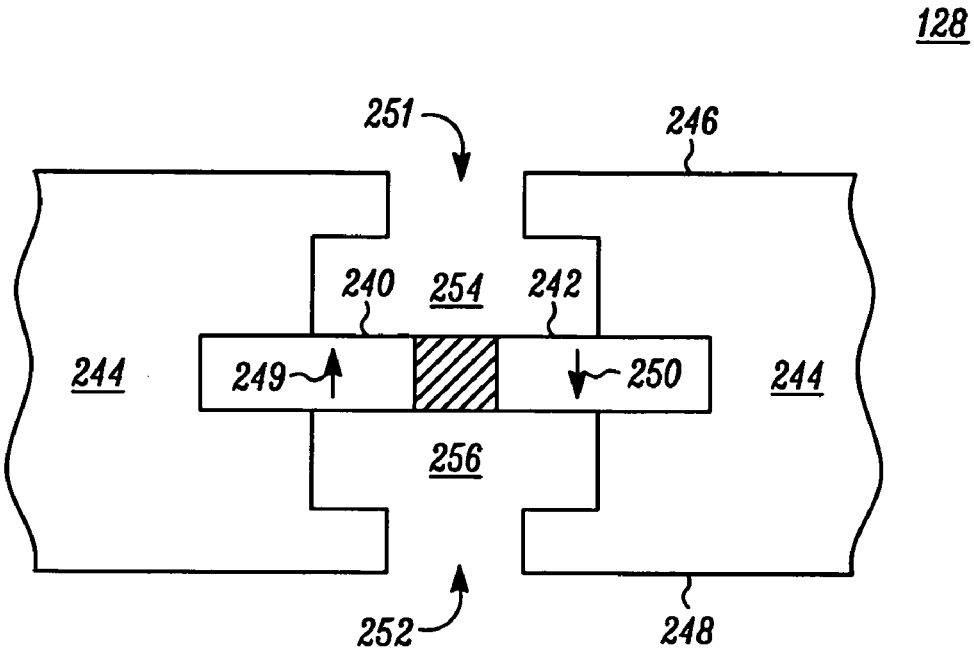
FIG. 2 is a cross section diagram of a microphone assembly in accordance with the first embodiment.

FIG. 2 is a cross section diagram of the microphone assembly 128 in accordance with the first embodiment. The microphone assembly 128 includes a first microphone capsule 240, a second microphone capsule 242 and a porting structure 244. The porting structure 244 encloses the first and second microphone capsules 240, 242 and has a first wall 246 and a second wall 248. The first microphone capsule 240 is a directional microphone having a first element axis 249. The second microphone capsule 242 is also a directional microphone capsule having a second element axis 250 with the second axis oriented about 180 degrees relative to the first axis forming an opposing pair of microphone capsules. The porting structure 244 is a shared symmetric porting structure with the first microphone capsule 240 and the second microphone capsule 242 sharing a first port 251 formed in the first wall 246 and a second port 252 formed in the second wall 248. As is apparent to one skilled in the art, the first port 251 and second port 252 can merely consist of a port, or can consist of a cavity 254, 256 coupled to the port 251, 252 as shown in FIG. 2.

In accordance with this first embodiment, both microphone capsules 240, 242 of the opposing pair are used for beam forming, and they are both ported through a single symmetric porting structure 244 such as a common grommet porting structure, thereby reducing the ports that have to be integrated into the electronic device 100 (shown in FIG. 1) in half, to the number required for a single directional microphone capsule. Both the first microphone capsule 240 and the second microphone capsule 242 are first order directional microphone elements, such as cardioid microphone capsules, which have the form $$P(\Theta)=\alpha+(1-\alpha)*\cos(\Theta),\text{ where } 0<\alpha<1.$$

Figure 3:
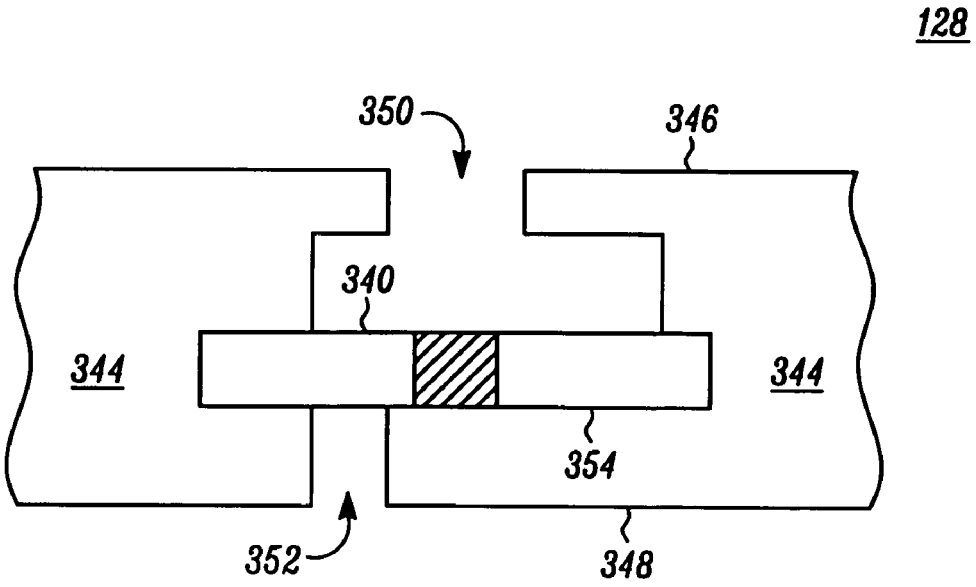
FIG. 3 is a cross section diagram of a microphone assembly in accordance with a second embodiment.

FIG. 3 is a cross section diagram of the microphone assembly 128 in accordance with a second embodiment. This alternate embodiment of the microphone assembly 128 includes a directional microphone capsule 340 and an omnidirectional microphone capsule 354. A porting structure 344 encloses the directional microphone capsule 340 and the omnidirectional microphone capsule 354 and has a first wall 346 and a second wall 348. The shared symmetric porting structure 344 has the omnidirectional microphone capsule 354 formed symmetrically with the directional microphone capsule 340, and the directional microphone capsule 340 and the omnidirectional microphone capsule 354 share a first port 350 while only the directional microphone capsule 340 utilizes a second port 352. The processing by the controller 120 shown in FIG. 1 for beam forming would be changed to reflect the change from creating a monopole by summing outputs from the two opposite directional microphone capsules 240, 242 of FIG. 2 to using the directional microphone capsule 340 output and the omnidirectional microphone capsule 354 output.

The use of the omnidirectional microphone capsule 354 along with the directional microphone capsule 340 also allows the controller 120 shown in FIG. 1 to bypass the gradient directional microphone capsule 340 for a true omnidirectional microphone in heavy wind noise conditions. The controller 120 receives information from the directional microphone capsule 340 and the omnidirectional microphone capsule 354 and, in response to the information, detects low wind noise conditions and high wind noise conditions. In response to detecting low wind noise conditions, the controller 120 provides a low wind noise signal to the microphone assembly 128 and, in response thereto, utilizes the directional microphone capsule 340 and the omnidirectional microphone capsule 354 for beam forming and steering to generate the information for providing to the controller 120. In response to the controller 120 detecting high wind noise conditions, the controller 120 provides a high wind noise signal to the microphone assembly 128 and utilizes only the omnidirectional microphone capsule 354 to generate the information to providing thereto. Alternatively, this process for audio signal enhancement can be manually overridden by the user of the electronic device 100.

Figure 4:
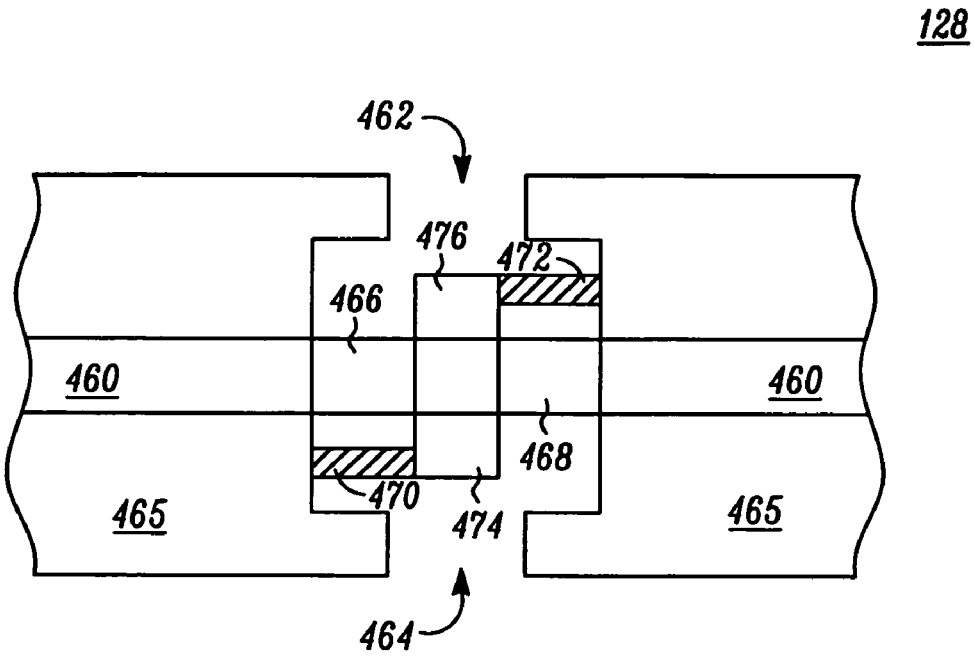
FIG. 4 is a cross section diagram of a semiconductor substrate of a microphone assembly in accordance with the first embodiment.

FIG. 4 is a cross section diagram of a semiconductor substrate 460 of the microphone assembly 128 in accordance with the first embodiment. In this embodiment, the microphone assembly 128 is shown formed from a single piece of silicon and a semiconductor package 465. A semiconductor substrate 460, such as a silicon layer, has a microphone array formed therein. The semiconductor package 465 includes a first porting structure 462 and a second porting structure 464 formed in the semiconductor package 465. A first microelectro-mechanical system (MEMS) microphone structure 466 is formed in the semiconductor substrate 460 and acoustically coupled to the first and second porting structures 462, 464. A second MEMS microphone structure 468 is also formed in the semiconductor substrate 460 and acoustically coupled to the first and second porting structures 462, 464. In this embodiment, both the first MEMS microphone structure 466 and the second MEMS microphone structure 468 are gradient microphones and, after delay elements 470 and 472, respectively, share common porting.

The first MEMS microphone structure 466 is formed in the semiconductor substrate 460 such that a first rear diaphragm branch 474 is formed by the second porting structure 464 and the first delay element 470 is formed from or placed in the semiconductor package 465, coupled to the first MEMS microphone structure 466 and integrated into the first rear diaphragm branch 474. Likewise, the second MEMS microphone structure 468 is formed in the semiconductor substrate 460 such that a second rear diaphragm branch 476 is formed by the first porting structure 462, and the second delay element 472 is formed from or placed in the semiconductor package 465 and integrated into the second rear diaphragm branch 476. The rear diaphragm branches 474, 476 and the delay elements 470, 472 are formed using known molding or laser cutting techniques.

Figure 5:
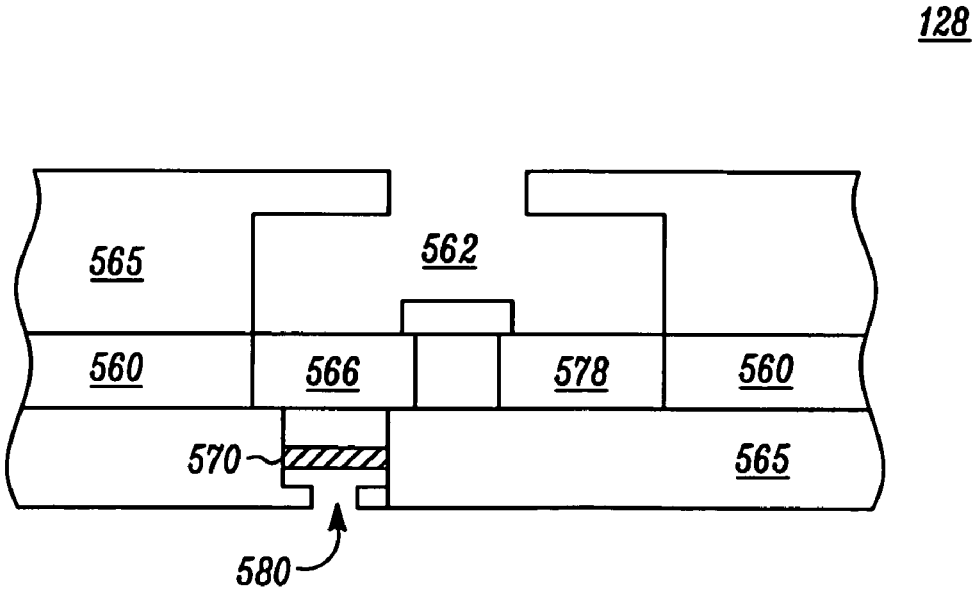
FIG. 5 is a cross section diagram of a semiconductor substrate of a microphone assembly in accordance with a second embodiment.

FIG. 5 is a cross section diagram of a semiconductor substrate of the microphone assembly 128 in accordance with a second embodiment. This alternate embodiment depicts a microphone assembly 128 formed in a semiconductor substrate 560 and a semiconductor package 565, where the microphone assembly includes a directional MEMS microphone element 566 and an omnidirectional MEMS microphone element 578. The directional MEMS microphone element 566 and the omnidirectional MEMS microphone element 578 share the first porting structure 562. However, the second porting structure 580 formed in the semiconductor package 565 is not symmetric to the first porting structure 562 and is only utilized by the directional MEMS microphone element 566 after delay element 570. In this alternate embodiment, the delay element 570 is added into the semiconductor package 565 using conventional semiconductor manufacturing processes instead of MEMS processing.

Figure 6:
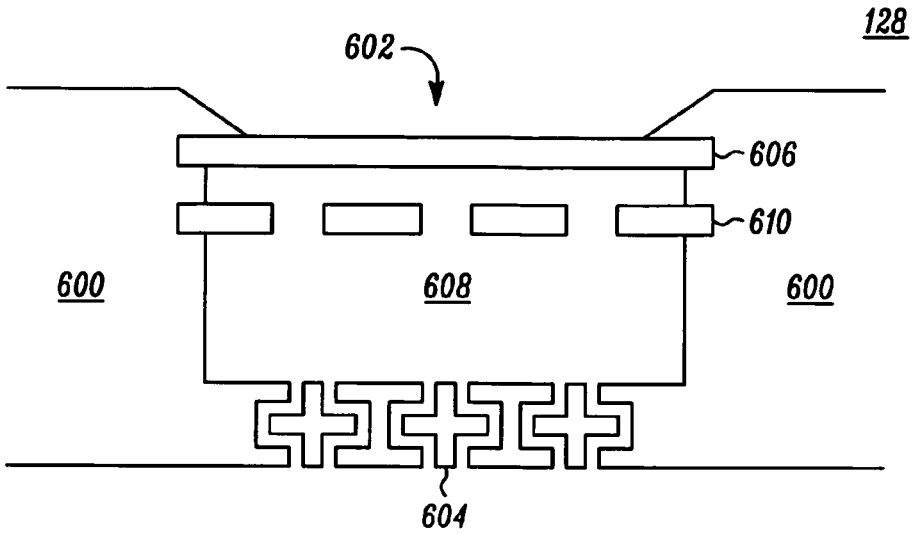
FIG. 6 is a cross section diagram of a semiconductor die in accordance with the first embodiment.

FIG. 6 is a cross section diagram of a semiconductor die 600 in accordance with the first embodiment. The semiconductor die 600 has a MEMS microphone structure 602 formed therein through planar MEMS semiconductor processing techniques. The MEMS microphone structure 602 is a first order microphone created from a single gradient (directional) microphone element with an acoustic delay added to the signal arriving at one side. In accordance with this embodiment, the MEMS microphone structure 602 includes frequency dependent acoustic resistance in the form of an acoustic labyrinth 604 formed in the semiconductor die 600 at the rear port of the MEMS microphone structure 602 to add the acoustic delay to the signal at one side of the gradient microphone. The acoustic labyrinth 604 is a three-dimensional acoustic labyrinth designed to have the appropriate frequency dependant acoustic resistance. A conductive diaphragm 606 is formed overlaying the acoustic labyrinth 604 to form a cavity 608 therebetween. A conductive backplate 610 is formed within the cavity through planar MEMS semiconductor processing techniques. Thus, it can be seen that this embodiment permits formation of all of the acoustic elements of a first order directional microphone in a single semiconductor die 600 during the semiconductor fabrication process so as not to add additional operations during the packaging process.

All conventional materials used for acoustic delay purposes, such as foam or a screen, utilize felting or weaving constraints which do not allow for the control of the size, depth or taper of individual holes across the section of the material. This embodiment advantageously provides a three-dimensional acoustic labyrinth 604 for acoustic resistance which can be designed to have the appropriate acoustic resistance versus frequency characteristics to give the required acoustic delay at each frequency over a usable range of frequencies to provide the appropriate first order directional beam pattern. The acoustic resistance can be calculated and designed using acoustic finite element analysis programs known to those skilled in the art, such as programs which utilize an optimization algorithm with inputs defining the appropriate acoustic resistance versus frequency curve. The process of forming the acoustic resistance 604 will significantly reduce the variation in acoustic impedance of the delay. More importantly, the process of forming the acoustic resistance 604 in accordance herewith will allow control over the resistance versus frequency response of the microphone element at a level not achievable with prior art microphone elements.

Figure 7:
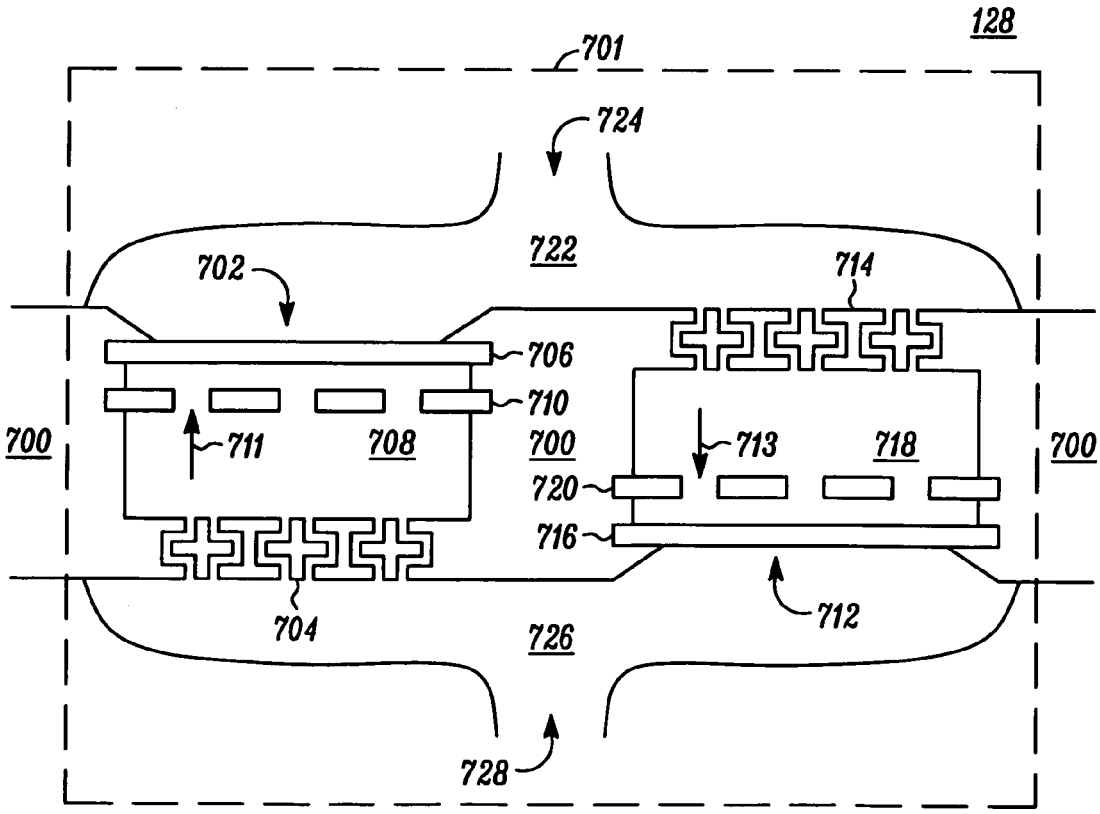
FIG. 7 is a cross section diagram of a microphone assembly in a semiconductor die in accordance with the first embodiment.

FIG. 7 is a cross section diagram of the microphone assembly 128 in a semiconductor die 700 in accordance with the first embodiment. The microphone assembly 128 includes a microphone array 701 which, in accordance with the first embodiment, is formed in a single semiconductor die 700. The microphone array 701 includes a first MEMS microphone structure 702 including an acoustic labyrinth 704 and a conductive diaphragm 706 defining a cavity 708 therebetween. A conductive backplate 710 is formed within the cavity 708. The first MEMS microphone structure 702 has a first axis 711. The microphone array further includes a second MEMS microphone structure 712 having a second axis 713 oriented about 180 degrees in relation to the first axis. The second MEMS microphone structure 712 similarly includes an acoustic labyrinth 714 and a conductive diaphragm 716 defining a cavity 718 having a conductive backplate 720 formed therein. The microphone array 701 includes a first porting structure 722 having a first common port 724 and a second porting structure 726 having a second common port 728, where the second porting structure 726 and the second common port 728 are formed symmetrical to the first porting structure 722 and the first common port 724. The first and second MEMS microphone structures 702, 712 are acoustically coupled to both the first and second common ports 724, 728. In operation, the first MEMS microphone structure 702 and the second MEMS microphone structure 712 are beam formed through processing of the information therefrom by the controller 120 (shown in FIG. 1).

Figure 8:
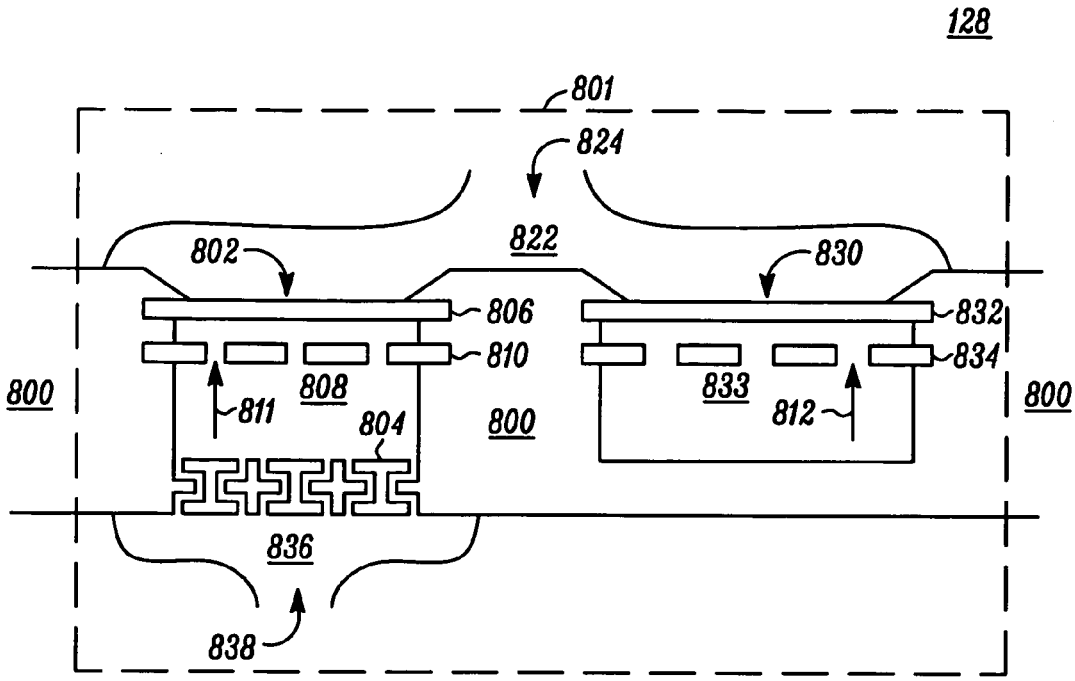
FIG. 8 is a cross section diagram of a microphone assembly in a semiconductor die in accordance with a second embodiment.

Additional microphone array structures can be formed from a single semiconductor die to achieve additionally improved acoustic reception. FIG. 8 is a cross section diagram of a microphone assembly 128 in a semiconductor die 800 in accordance with the second embodiment. In this embodiment, the microphone array 801 includes a first directional MEMS microphone structure 802 including an acoustic labyrinth 804 and a conductive diaphragm 806 defining a cavity 808 with a conductive backplate 810 formed within the cavity 808. The first MEMS microphone structure 802 has a first axis 811. The microphone array 801 further includes a second MEMS microphone structure 830 having a second axis 812 oriented about zero degrees in relation to the first axis. The second MEMS microphone structure 830 is an omnidirectional microphone element and includes a conductive diaphragm 832 defining a cavity 833 with the semiconductor die 800 and having a conductive backplate 834 formed in the cavity 833. The microphone array includes a first porting structure 822 having a first common port 824 and a second porting structure 836 having a rear port 838. The first and second MEMS microphone structures 802, 830 are acoustically coupled to the first common port 824, and the rear port 838 is utilized by the first MEMS microphone structure 802. In operation, the first MEMS microphone structure 802 and the second MEMS microphone structure 830 are utilized in high wind noise conditions and low wind noise conditions under the control of the controller 120 (shown in FIG. 1) for processing of the information therefrom by the controller 120.

Figure 9:
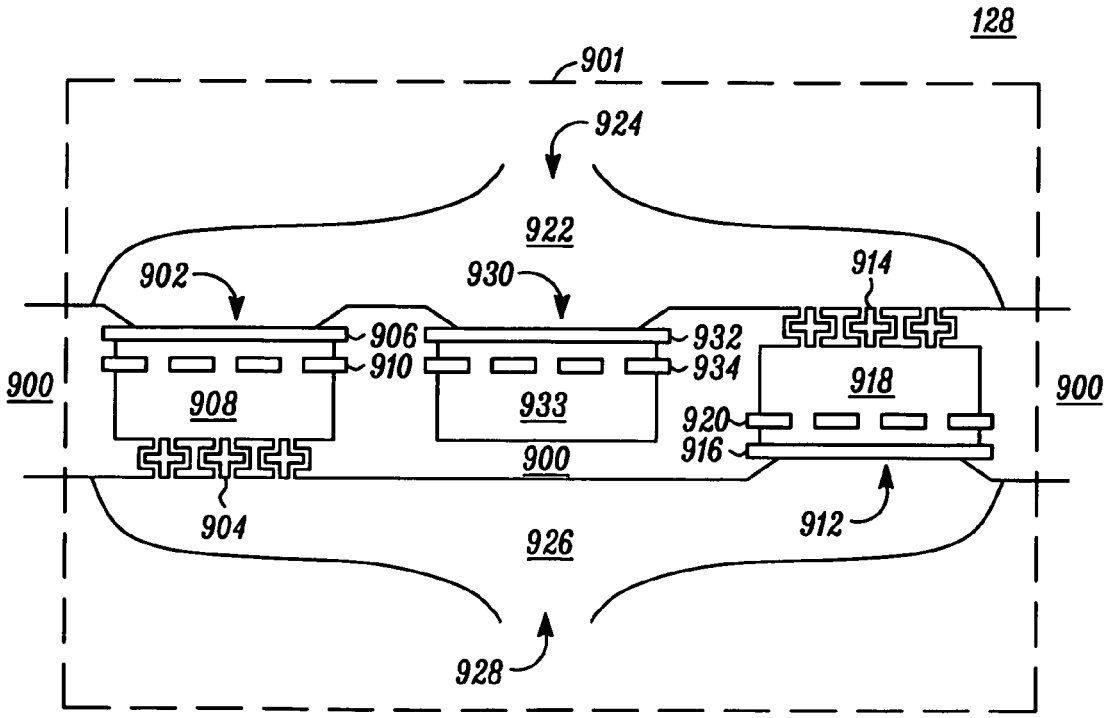
FIG. 9 is a cross section diagram of a microphone assembly in a semiconductor die in accordance with a third embodiment.

FIG. 9 is a cross section diagram of a microphone assembly 128 in a semiconductor die 900 in accordance with a third embodiment. This embodiment depicts a microphone array 901 that can utilize beam forming as well as audio signal enhancement by combining a first MEMS microphone structure 902 that is a directional microphone, a second MEMS microphone structure 930 that is an omnidirectional microphone and is oriented about zero degrees in relation to the first MEMS microphone structure 902, and a third MEMS microphone structure 912 that is a directional microphone and is oriented about 180 degrees in relation to the first MEMS microphone structure 902.

The first directional MEMS microphone structure 902 includes an acoustic labyrinth 904 and a conductive diaphragm 906 defining a cavity 908 having a conductive backplate 910 formed therein. The omnidirectional MEMS microphone structure 930 includes a conductive diaphragm 932 defining a cavity 933 with the semiconductor die 900 and having a conductive backplate 934 formed in the cavity 933. The second directional MEMS microphone structure 912 includes an acoustic labyrinth 914 and a conductive diaphragm 916 defining a cavity 918 and having a conductive backplate 920 formed in the cavity 918.

The microphone array 901 includes a first porting structure 922 having a first common port 924 and a second porting structure 926 having a second common port 928, where the second porting structure 926 is formed symmetrical to the first porting structure 922. The first and second directional MEMS microphone structures 902, 912 and the omnidirectional MEMS microphone structure 930 are acoustically coupled to the first common port 924 and the first and second directional MEMS microphone structures 902, 912 are acoustically coupled to the second common port 928. In operation, the first directional MEMS microphone structure 902 and the second directional MEMS microphone structure 912 are beam formed through processing of the information therefrom by the controller 120 (shown in FIG. 1), and the first and second directional MEMS microphone structures 902, 912 and the omnidirectional MEMS microphone structure 930 are utilized for audio signal enhancement in high wind noise conditions and low wind noise conditions under the control of the controller 120 for processing of the information therefrom by the controller 120.

It should be appreciated that the embodiments that have been presented can be reproduced more than one time on a single silicon die adding an additional shared symmetric porting structure for each instance of the replication. In this manner, the methods of both beam forming and steering of the formed beam taught in the related U.S. patent application Ser. No. 11/021,350 entitled "Method and Apparatus for Audio Signal Enhancement" by Robert A. Zurek can be realized in a single semiconductor device.

Figure 10:
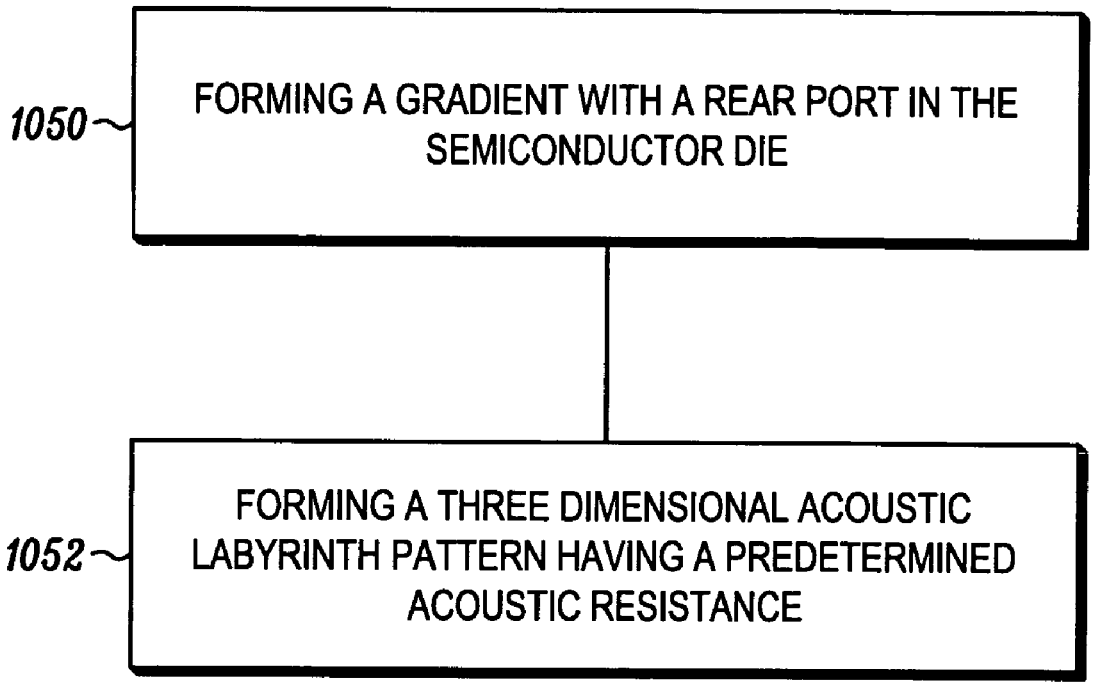
FIG. 10 is a flow diagram of a method for making the semiconductor die of FIG. 6 in accordance with the first embodiment.

FIG. 10 is a flow diagram of a method for making the semiconductor die of FIG. 6 in accordance with the first embodiment. The method for manufacturing a first order directional semiconductor microphone in a semiconductor die is shown in two steps. First, a gradient microphone with a rear port is formed in the semiconductor die 1050. Next, a three-dimensional acoustic labyrinth pattern is formed 1052 having a predetermined multi-octave, frequency dependent acoustic resistance. In this manner, a first order microphone can be created from a single gradient microphone by adding acoustic resistance thereto to create an acoustic delay to the signals arriving at one side of the gradient microphone.

While several exemplary embodiments have been presented in the foregoing detailed description of the embodiments, it should be appreciated that a vast number of variations exist. It should also be appreciated that the exemplary embodiments are only examples, and are not intended to limit the scope, applicability, or configuration of the invention in any way. Rather, the foregoing detailed description will provide those skilled in the art with a convenient road map for implementing an exemplary embodiment of the invention, it being understood that various changes may be made in the function and arrangement of elements described in an exemplary embodiment without departing from the scope of the invention as set forth in the appended claims.

What is claimed is:

1. A microphone assembly comprising:

a first microphone capsule, wherein the first microphone capsule is a directional microphone capsule having a first element axis;

a second microphone capsule, wherein the second microphone capsule is a directional microphone capsule having a second element axis oriented about 180 degrees relative to the first element axis; and a porting structure for enclosing the first microphone capsule and the second microphone capsule, the porting structure having a first port formed in a first wall of the porting structure and a second port formed in a second wall of the porting structure opposite to the first wall, wherein the first microphone capsule and the second microphone capsule share the first port.

2. The microphone assembly of claim 1 wherein the porting structure is a symmetric porting structure having the second microphone capsule formed symmetrically with the first microphone capsule in the porting structure, and wherein the first microphone capsule and the second microphone capsule also share the second port.

3. The microphone assembly of claim 2 wherein the first microphone capsule and the second microphone capsule are utilized for beam forming.

4. The microphone assembly of claim 1 wherein the first microphone capsule and the second microphone capsule each comprise a first order directional microphone element.

5. The microphone assembly of claim 4 wherein the first order directional microphone elements comprise cardioid microphone elements.

6. A microphone assembly comprising:

a directional microphone capsule;

an omnidirectional microphone capsule; and a symmetric porting structure for enclosing the directional microphone capsule positioned symmetrically with the omnidirectional microphone capsule, the symmetric porting structure having a first port formed in a first wall of the symmetric porting structure and a second port formed in a second wall of the symmetric porting structure opposite to the first wall, wherein the directional microphone capsule and the omnidirectional microphone capsule share the first port, and wherein the directional microphone capsule utilizes the second port.

7. An electronic device comprising:

a user interface including a microphone assembly having a directional microphone capsule, an omnidirectional microphone capsule, and a symmetric porting structure for enclosing the directional microphone capsule positioned symmetrically with the omnidirectional microphone capsule, the porting structure having a first port formed in a first wall of the porting structure and a second port formed in a second wall of the porting structure opposite to the first wall, wherein the directional microphone capsule and the omnidirectional microphone capsule share the first port, and wherein the directional microphone capsule utilizes the second port; and a controller coupled to the user interface for receiving information therefrom and for providing signals to the user interface for operation of the microphone assembly in response thereto.

8. The electronic device of claim 7 wherein the controller receives the information from the directional microphone capsule and the omnidirectional microphone capsule and, in response to said information, detects low wind noise conditions and high wind noise conditions and wherein the controller provides a low wind noise signal to the microphone assembly in response to detecting low wind noise conditions, and wherein the microphone assembly utilizes the directional microphone capsule and the omnidirectional microphone capsule for beam forming and steering to generate the information for providing to the controller in response to the low wind noise signal.

9. The electronic device of claim 8 wherein the controller provides a high wind noise signal to the microphone assembly in response to detecting high wind noise conditions, and wherein the microphone assembly utilizes only the omnidirectional microphone capsule to generate the information for providing to the controller in response to the high wind noise signal.

10. The electronic device of claim 7 further comprising:

an antenna for receiving and transmitting radio frequency (RF) signals;

receiver circuitry coupled to the antenna for demodulating and decoding the RF signals to derive information therefrom; and transmitter circuitry coupled to the antenna for encoding and modulating information into RF signals, and wherein the controller is coupled to the microphone assembly for providing signals thereto and for receiving information therefrom, and the controller is further coupled to the receiver for receiving information therefrom and coupled to the transmitter circuitry for providing information thereto.

11. An electronic device comprising:

a user interface including a microphone assembly having:

a first microphone capsule, wherein the first microphone capsule is a directional microphone capsule having a first element axis;

a second microphone capsule, wherein the second microphone capsule is a directional microphone capsule having a second element axis oriented about 180 degrees relative to the first element axis; and a porting structure for enclosing the first microphone capsule and the second microphone capsule, the porting structure having a first port formed in a first wall of the porting structure and a second port formed in a second wall of the porting structure opposite to the first wall, wherein the first microphone capsule and the second microphone capsule share the first port; and a controller coupled to the user interface for receiving information therefrom and for providing signals to the user interface for operation of the microphone assembly in response thereto.

* * * * *